US011268175B2

(12) United States Patent
Um et al.

(10) Patent No.: US 11,268,175 B2
(45) **Date of Patent: *Mar. 8, 2022**

(54) HIGH-STRENGTH STEEL HAVING EXCELLENT FRACTURE INITIATION RESISTANCE AND FRACTURE PROPAGATION ARRESTABILITY AT LOW TEMPERATURE AND METHOD OF MANUFACTURING THE SAME

(71) Applicant: POSCO, Pohang-si (KR)

(72) Inventors: Kyung-Keun Um, Pohang-si (KR); Woo-Gyeom Kim, Pohang-si (KR); Woo-Yeol Cha, Pohang-si (KR); Jin-Woo Chae, Pohang-si (KR)

(73) Assignee: POSCO, Pohang-si (KR)

( * ) Notice: Subject to any disclaimer, the term of this patent is extended or adjusted under 35 U.S.C. 154(b) by 195 days.

This patent is subject to a terminal disclaimer.

(21) Appl. No.: 16/468,886

(22) PCT Filed: Dec. 22, 2017

(86) PCT No.: PCT/KR2017/015410

§ 371 (c)(1),
(2) Date: Jun. 12, 2019

(87) PCT Pub. No.: WO2018/117766

PCT Pub. Date: Jun. 28, 2018

(65) Prior Publication Data

US 2020/0080179 A1 Mar. 12, 2020

(30) Foreign Application Priority Data

Dec. 23, 2016 (KR) ..... 10-2016-0178102

(51) Int. Cl.
*C22C 38/20* (2006.01)
*C21D 8/02* (2006.01)
(Continued)

(52) U.S. Cl.
CPC ..... *C22C 38/20* (2013.01); *C21D 8/021* (2013.01); *C21D 8/0205* (2013.01);
(Continued)

(58) Field of Classification Search
CPC ..... C22C 38/20; C21D 8/0205; C21D 8/021; C21D 8/0226; C21D 9/0081; C21D 9/46;
(Continued)

(56) References Cited

U.S. PATENT DOCUMENTS 6,669,789 B1 * 12/2003 Edelman ..... C21C 7/0006 148/320
2009/0255610 A1 * 10/2009 Yoshinaga ..... C23C 2/28 148/537
(Continued)

FOREIGN PATENT DOCUMENTS

CN 101831588 A 9/2010
JP 2002-194488 A 7/2002
(Continued)

OTHER PUBLICATIONS

KR-20150075292-A, Chon Seung Hwan; Jung Eui Gyeong; Kang Sang Deok, English Translation provided from EPO, 2015 (Year: 2015).*
(Continued)

*Primary Examiner* — Nicholas A Wang
*Assistant Examiner* — Jacob J Gusewelle
(74) *Attorney, Agent, or Firm* — Morgan, Lewis & Bockius LLP

(57) ABSTRACT

An aspect of the present invention relates to a high-strength steel, having excellent fracture initiation resistance and fracture propagation arrestability at low temperature.

6 Claims, 2 Drawing Sheets

(51) Int. Cl.

| | |
|---|---|
| ***C21D 9/00*** | (2006.01) |
| ***C21D 9/46*** | (2006.01) |
| ***C21D 1/18*** | (2006.01) |
| ***C22C 38/34*** | (2006.01) |

(52) U.S. Cl.
CPC ..... *C21D 8/0226* (2013.01); *C21D 9/0081* (2013.01); *C21D 9/46* (2013.01); *C22C 38/34* (2013.01); *C21D 1/18* (2013.01); *C21D 2211/001* (2013.01); *C21D 2211/005* (2013.01); *C21D 2211/008* (2013.01)

(58) Field of Classification Search
CPC ..... C21D 2211/001; C21D 2211/005; C21D 2211/008
See application file for complete search history.

(56) References Cited

U.S. PATENT DOCUMENTS

| | | | |
|---|---|---|---|
| 2010/0263773 | A1 | 10/2010 | Cho et al. |
| 2013/0037162 | A1 | 2/2013 | Shinohara et al. |
| 2016/0017456 | A1 | 1/2016 | Terazawa et al. |
| 2017/0137905 | A1 | 5/2017 | Ichimiya et al. |
| 2017/0275727 | A1 | 9/2017 | Ichimiya et al. |

FOREIGN PATENT DOCUMENTS

| | | | | |
|---|---|---|---|---|
| JP | 2003-064442 | A | | 3/2003 |
| JP | 2006-002236 | A | | 1/2006 |
| JP | 2007270198 | A | * | 10/2007 |
| JP | 2010-209433 | A | | 9/2010 |
| JP | 2012-072421 | A | | 4/2012 |
| JP | 2013-095927 | A | | 5/2013 |
| JP | 2013-95928 | A | | 5/2013 |
| JP | WO2014-141633 | A1 | | 9/2014 |
| KR | 10-2002-0028203 | A | | 4/2002 |
| KR | 100431866 | B1 | * | 5/2004 |
| KR | 10-2009-0052950 | A | | 5/2009 |
| KR | 10-2009-0066639 | A | | 6/2009 |
| KR | 10-2011-0025871 | A | | 3/2011 |
| KR | 10-2012-0062017 | A | | 6/2012 |
| KR | 10-2013-0131105 | A | | 12/2013 |
| KR | 10-2015-0074706 | A | | 7/2015 |
| KR | 10-2015-0075292 | A | | 7/2015 |
| KR | 10-2015-0076888 | A | | 7/2015 |
| KR | 20150075292 | A | * | 7/2015 |
| WO | 2015/151519 | A1 | | 10/2015 |
| WO | WO-2015151519 | A1 | * | 10/2015 ..... C22C 38/001 |
| WO | 2016/035110 | A1 | | 3/2016 |

OTHER PUBLICATIONS

WO-2015151519-A1, Endo Shigeru; Hase Kazukuni; Ichimiya Katsuyuki; Yuga Masao, English Translation provided from EPO, 2015 (Year: 2015).*

Extended European Search Report dated Sep. 13, 2019 issued in European Patent Application No. 17882915.6.

Japanese Office Action dated Jul. 28, 2020 issued in Japanese Patent Application No. 2019-533439.

Chinese Office Action dated Sep. 3, 2020 issued in Chinese Patent Application No. 201780079841.8 (with English translation).

International Search Report dated Mar. 30, 2018 issued in corresponding International Patent Application No. PCT/KR2017/015410.

* cited by examiner

HIGH-STRENGTH STEEL HAVING EXCELLENT FRACTURE INITIATION RESISTANCE AND FRACTURE PROPAGATION ARRESTABILITY AT LOW TEMPERATURE AND METHOD OF MANUFACTURING THE SAME

CROSS-REFERENCE OF RELATED APPLICATIONS

This application is the U.S. National Phase under 35 U.S.C. § 371 of International Patent Application No. PCT/KR2017/015410, filed on Dec. 22, 2017, which in turn claims the benefit of Korean Patent Application No. 10-2016-0178102, filed Dec. 23, 2016, the entire disclosures of which applications are incorporated by reference herein.

TECHNICAL FIELD

The present disclosure relates to a high-strength steel having excellent fracture initiation resistance and fracture propagation arrestability at low temperature which may be appropriately applied to a steel used for a shipbuilding offshore structure, and a method of manufacturing the same.

BACKGROUND ART

Due to the exhaustion of energy sources, the mining of resources has been gradually moved to deep sea regions or extremely cold regions, and accordingly, mining and storage facilities have increased sizes and more complex structures. Thus, a thickness of steel in such fields has increased, and steel has been designed to have high strength.

As a thickness of a steel has increased and high strength steel has been developed, the amount of addition of alloy elements has increased. A large amount of alloy elements may cause the problem of degradation of toughness during a welding manufacturing process.

The reason why toughness of a welding heat affected zone may degrade is as follows.

During welding, in a heat affected zone exposed to a high temperature of 1200° C. or higher, a microstructure may become coarse due to the high temperature, and a hard low temperature structure may increase due to a high cooling rate such that toughness may be deteriorated at a low temperature. Also, a heat affected zone may go through a history of various temperature changes due to many welding passes, and particularly, in a region in which a final pass passes an austenite-ferrite two-phase temperature region, austenite may be reverse-transformed and formed when a temperature rises, and the phenomenon in which C around austenite is integrated and thickened may occur. During a subsequent cooling process, a partial region may be transformed to martensite having high hardness due to increased hardenability or may remain as austenite, which may be referred to as an MA phase (martensite-austenite multiphase) or a martensite-austenite constituent. An MA phase having high hardness may be sharp, such that stress concentration may increase, and deformation of a soft ferrite matrix around the MA phase may be concentrated due to high hardness such that the MA phase may work as a starting point of fracturing. Thus, to increase fracture initiation resistance and fracture propagation arrestability at low temperature, the formation of the MA in a welding heat affected zone may need to be significantly reduced. Further, when a use environment temperature decreases as in polar regions, fracture initiation and propagation may more easily occur. Thus, it may be necessary to prevent an MA phase.

To address the above-described problem, 1) a method of forming a fine inclusion in a steel material to form minute acicular ferrite by the inclusion during a cooling process after a welding heat affected zone becomes coarse at a high temperature and to prevent an MA phase at the same time (generally, referred to as oxide metallurgy), 2) a method of decreasing contents of C, Si, Mn, Mo, Sol.Al, and Nb, elements which may cause the formation of an MA phase, by increasing stability of austenite formed during a heating process for a two-phase region, 3) a method of greatly increasing a content of Ni, an element which may improve low temperature toughness of a ferrite matrix in acicular ferrite or various types of bainite, 4) a method of decreasing hardness by decomposing a formed MA phase by reheating a welding heat affected zone at 200 to 650° C. after welding, and other methods, have been developed.

However, as structures have been designed to have large sizes, and a use environment has been changed to a polar environment, there may be the problem in which it may be difficult to sufficiently secure fracture initiation resistance and fracture propagation arrestability at low temperature simply by applying the above-described conventional methods.

Thus, it has been required to develop a high-strength steel having improved fracture initiation resistance and fracture propagation arrestability at low temperature, and a method of manufacturing the same.

PRIOR ART (Reference 1) Korean Laid-Open Patent Publication No. 2002-0028203

DISCLOSURE

Technical Problem

An aspect of the present disclosure is to provide a high-strength steel having excellent fracture initiation resistance and fracture propagation arrestability at low temperature, and a method of manufacturing the same.

However, aspects of the present disclosure are not limited thereto. Additional aspects will be set forth in part in the description which follows, and will be apparent from the description to those of ordinary skill in the related art.

Technical Solution

An aspect of the present disclosure relates to a high-strength steel having excellent fracture initiation resistance and fracture propagation arrestability at low temperature, the high-strength steel including, by wt %, 0.02 to 0.09% of C, 0.005 to 0.3% of Si, 0.5 to 1.7% of Mn, 0.001 to 0.035% of Sol.Al, 0.03% or less of Nb, excluding 0%, 0.01% or less of V, excluding 0%, 0.001 to 0.02% or Ti, 0.01 to 0.1% of Cu, 0.01 to 2.0% of Ni, 0.01 to 0.5% of Cr, 0.001 to 0.5% of Mo, 0.0002 to 0.005% of Ca, 0.001 to 0.006% of N, 0.02% or less of P, excluding 0%, 0.003% or less of 5, excluding 0%, 0.002% or less of 0, excluding 0%, and a balance of Fe and inevitable impurities, the high-strength steel satisfies Relational Expression 1 below, and a microstructure comprises a sum of polygonal ferrite and acicular ferrite of 50 area % or higher, and comprises a martensite-austenite multiphase, an MA phase, of 3.5 area % or lower.

$$5*C+Si+10*sol.Al \leq 0.6 \quad \text{Relational Expression 1}$$

(in Relational Expression 1, each element symbol indicates a content of each element by wt %)

Another aspect of the present disclosure relates to a method of manufacturing a high-strength steel having excellent fracture initiation resistance and fracture propagation arrestability at low temperature, the method including preparing a slab satisfying the above-described alloy composition; heating the slab to 1000 to 1200° C.; finish-hot-rolling the heated slab at 680° C. or higher and obtaining a hot-rolled steel sheet; and cooling the hot-rolled steel sheet.

Also, the above-described technical solutions do not list all the features of the present disclosure. Various features and advantages and effects thereof of the present disclosure will further be understood with reference to specific embodiments described below.

Advantageous Effects

According to an aspect of the present disclosure, there may be an effect of providing a steel having improved fracture initiation resistance and fracture propagation arrestability at low temperature and a method of manufacturing the same.

BEST MODE FOR INVENTION

Figure 1:
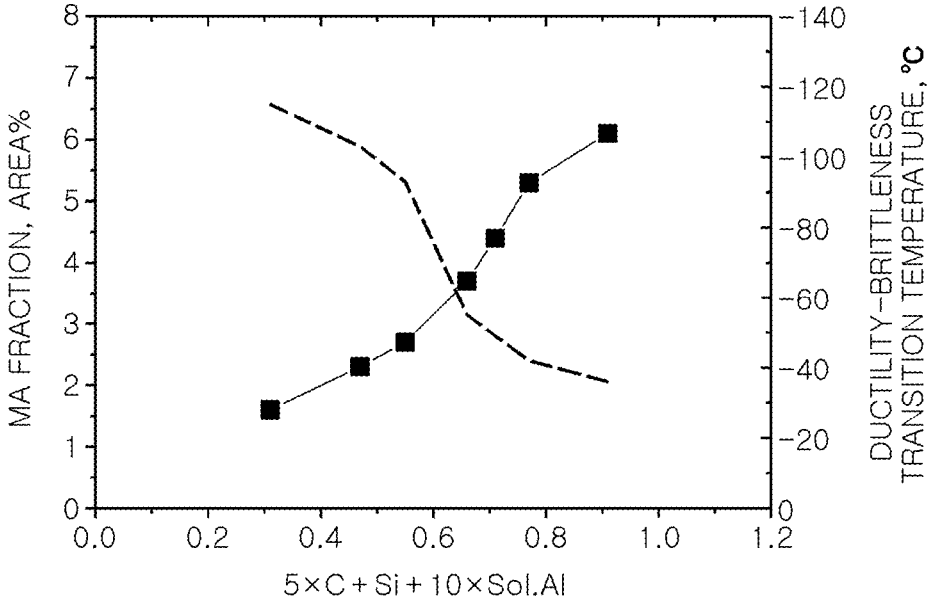
FIG. 1 is graphs illustrating changes of an MA phase fraction (solid line) and a ductility-brittleness transition temperature (dotted line) in accordance with a value of Relational Expression 1 with respect to inventive examples 1 to 3 and comparative examples 1, 2, 8, to 9.
Figure 2:
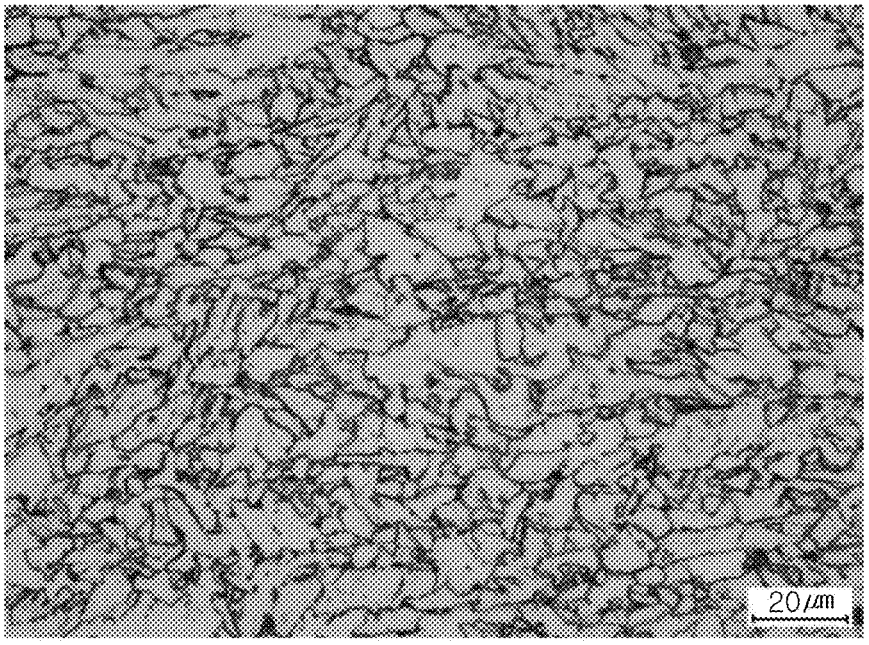
FIG. 2 is an image of a microstructure of inventive example 2 obtained by using an optical microscope.
Figure 3:
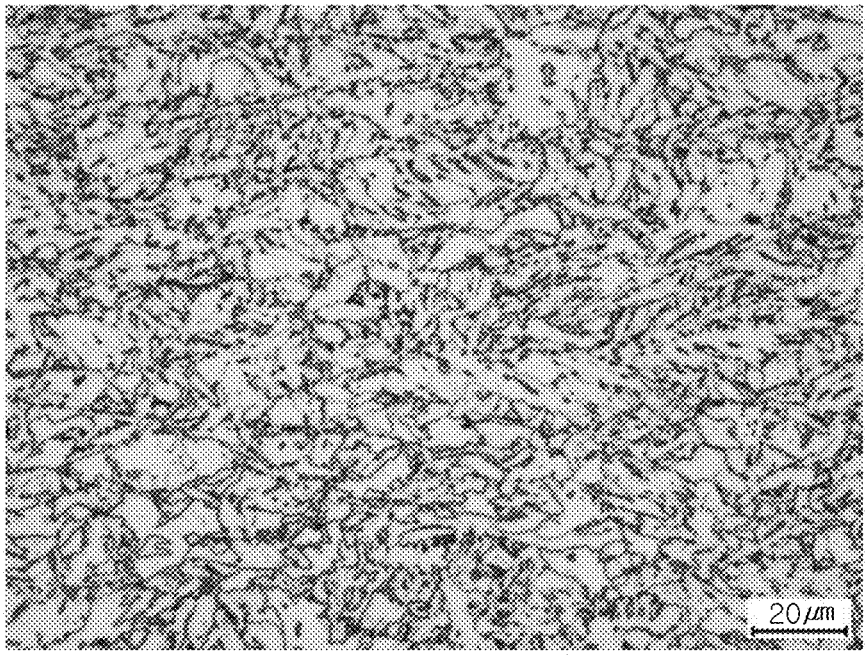
FIG. 3 is an image of a microstructure of comparative example 7 obtained by using an optical microscope.

In the description below, preferable embodiment of the present invention will be described. However, embodiments of the present disclosure may be modified in various manners, and the scope of the present disclosure may not be limited to the embodiments described below. Also, the embodiments may be provided to more completely describe the present disclosure to a person having ordinary skill in the art.

The inventors have conducted research to further improve fracture initiation resistance and fracture propagation arrestability at low temperature, and have found that, by accurately controlling correlations between alloy elements, particularly, correlations between C, Si, and Sol.Al, a microstructure of a steel material may include a sum of polygonal ferrite and acicular ferrite of 50 area % or higher, and may include an MA phase (martensite-austenite multiphase) of 3.5 area % or lower. Accordingly, it has been found that fracture initiation resistance and fracture propagation arrestability at low temperature may significantly improve, and the present disclosure has been suggested.

High-Strength Steel Having Excellent Fracture Initiation Resistance and Fracture Propagation Arrestability at Low Temperature In the description below, a high-strength steel having excellent fracture initiation resistance and fracture propagation arrestability at low temperature will be described in detail.

A high-strength steel having excellent fracture initiation resistance and fracture propagation arrestability at low temperature according to an aspect of the present disclosure may include, by wt %, 0.02 to 0.09% of C, 0.005 to 0.3% of Si, 0.5 to 1.7% of Mn, 0.001 to 0.035% of Sol.Al, 0.03% or less of Nb (excluding 0%), 0.01% or less of V (excluding 0%), 0.001 to 0.02% or Ti, 0.01 to 0.1% of Cu, 0.01 to 2.0% of Ni, 0.01 to 0.5% of Cr, 0.001 to 0.5% of Mo, 0.0002 to 0.005% of Ca, 0.001 to 0.006% of N, 0.02% or less of P (excluding 0%), 0.003% or less of S (excluding 0%), 0.002% or less of 0 (excluding 0%), and a balance of Fe and inevitable impurities, and may satisfy Relational Expression 1 below.

A microstructure may include a sum of polygonal ferrite and acicular ferrite of 50 area % or higher, and may include an MA phase (martensite-austenite multiphase) of 3.5 area % or lower.

$$5*C+Si+10*sol.Al \leq 0.6 \qquad \text{Relational Expression 1}$$

(in Relational Expression 1, each element symbol indicates a content of each element by wt %)

An alloy composition of the steel of the present disclosure will be described in detail. A unit of a content of each element may be wt %.

C: 0.02 to 0.09%

C is an element which may be important for securing strength and toughness at the same time by forming acicular ferrite or lath bainite.

When a content of C is lower than 0.02%, C may rarely be dispersed and may be transformed to a coarse ferrite structure such that there may be the problem of degradation of strength and toughness of the steel. When a content of C exceeds 0.09%, an MA phase may be excessively formed, and a coarse MA phase may be formed such that there may be the problem of significant deterioration of fracture initiation resistance at a low temperature. Thus, a preferable content of C may be 0.02 to 0.09%.

A more preferable lower limit content of C may be 0.025%, an even more preferable lower limit content of C may be 0.03%.

A more preferable upper limit content of C may be 0.085%, and an even more preferable upper limit content of C may be 0.08%.

Si: 0.005 to 0.3%

Si is an element which may be added for the purpose of deoxidation, desulfurization, and also solid solution strengthening. However, although an effect of increasing yield strength and tensile strength of Si is insignificant, Si may greatly increase stability of austenite in a welding heat affected zone such that a fraction of an MA phase may increase, and accordingly, there may be the problem in which fracture initiation resistance at a low temperature may be greatly deteriorated. Thus, in the present disclosure, it may be preferable to control a content of Si to be 0.3% or less. To control a content of Si to be lower than 0.005%, there may be the problem in which a processing time in a steel making process may greatly increase such that production costs may increase, and productivity may degrade. Thus, a preferable lower limit content of Si may be 0.005%.

A more preferable lower limit content of Si may be 0.007%, and an even more preferable lower limit content of Si may be 0.01%. Also, a more preferable upper limit content of Si may be 0.25%, and an even more upper limit content of Si may be 0.2%.

Mn: 0.5 to 1.70

Mn may have a significant effect in increasing strength by strengthening solid solution, and a decrease of toughness at a low temperature may be insignificant. Thus, 0.5% or higher of Mn may be added.

However, when Mn is excessively added, segregation in a central portion taken in a thickness direction of a steel sheet may increase, and Mn may cause the formation of MnS, a non-metal inclusion, along with segregated S at the same time. The MnS inclusion formed in the central portion may be elongated by a subsequent rolling process, and may consequently degrade fracture initiation resistance and fracture propagation arrestability at low temperature. Thus, a preferable upper limit content of Mn may be 1.7%.

Thus, a preferable content of Mn may be 0.5 to 1.7%. A more preferable lower limit content of Mn may be 0.7%, and an even more preferable upper limit content may be 1.0%. Also, a preferable upper limit content of Mn may be 1.68%, and an even more preferable upper limit content may be 1.65%.

Sol.Al: 0.001 to 0.035%

Sol.Al may be used as a strong deoxidizer in a steel making process along with Mn, and the above-describe effect may be sufficiently obtained by adding at least 0.001% or higher of sol.Al in single or dual deoxidation.

However, when a content of sol.Al exceeds 0.035%, the above-described effect may be saturated, and a fraction of Al2O3 in an oxidized inclusion formed as a result of deoxidation may excessively increase such that a size of the inclusion may become coarse, and the inclusion may not be properly removed during refining. Accordingly, there may be the problem in which low temperature toughness of the steel material may greatly decrease. Also, similarly to Si, sol.Al may facilitate the formation of an MA phase in a welding heat affected zone such that fracture initiation resistance and fracture propagation arrestability at low temperature may greatly degrade.

Thus, a preferable content of sol.Al may be 0.001 to 0.035%.

Nb: 0.03% or less (excluding 0%)

Nb is an element which may be solute to austenite and may increase hardenability of austenite. Also, Nb may be precipitated as fine carbides (Nb,Ti) (C,N) during hot-rolling, and may prevent recrystallization during rolling or cooling such that Nb may have a significant effect in refining a final microstructure. However, when an excessive content of Nb is added, Nb may facilitate the formation of an MA phase in a welding heat affected zone such that fracture initiation resistance and fracture propagation arrestability at low temperature may greatly degrade. Thus, in the present disclosure, a content of Nb may be controlled to be 0.03% or less (excluding 0%).

V: 0.01% or less (excluding 0%)

As for V, most of V may be re-solute during reheating a slab, and may be mostly precipitated during cooling after rolling and may improve strength. However, in a welding heat affected zone, V may be dissolved at a high temperature such that V may greatly increase hardenability and may facilitate the formation of an MA phase. Thus, a content of V may be limited to be 0.01% or less (excluding 0%).

Ti: 0.001 to 0.02%

Ti may be present as a hexahedral precipitation in fine TiN form mostly at a high temperature, or when Ti is added along with Nb, (Ti,Nb) (C,N) precipitations may be formed such that there may be an effect of preventing grain growth of a base material and a welding heat affected zone.

To sufficiently obtain the above-described effect, it may be preferable to add 0.001% or higher of Ti, and to maximize the effect of addition of Ti, it may be preferable to increase a content of Ti in accordance with a content of N to be added. When a content of Ti exceeds 0.02%, excessively coarse carbonitride may be formed and may work as an initiation point of fracture cracks, and accordingly, impact properties of a welding heat affected zone may greatly decrease. Thus, a preferable content of Ti may be 0.001 to 0.02%.

Cu: 0.01 to 1.0%

Cu is an element which may greatly improve strength by solid solution and precipitation without greatly deteriorating fracture initiation resistance and fracture propagation arrestability.

When a content of Cu is lower than 0.01%, the above-described effect may be insufficient. When a content of Cu exceeds 1.0%, cracks may be created on a surface of the steel material. Also, as Cu is a relatively expensive element, there may be the problem of an increase of raw material costs.

Ni: 0.01 to 2.0%

Ni may rarely have an effect of increasing strength, but may be effective for improving fracture initiation resistance and fracture propagation arrestability at low temperature. Particularly, when Cu is added, Ni may have an effect of preventing surface cracks caused by selective oxidation occurring during reheating a slab.

When a content of Ni is lower than 0.01%, the above-described effect may be insufficient. When a content of Ni exceeds 2.0%, there may be the problem of an increase of raw material costs as Ni is an expensive element.

Cr: 0.01 to 0.5%

Cr may have an insignificant effect in increasing yield strength and tensile strength by solid solution. However, due to high hardenability, Cr may form a fine structure even when a thick material is cooled at a low cooling rate, and accordingly, Cr may have an effect of improving strength and toughness.

When a content of Cr is lower than 0.01%, the above-described effect may be insufficient. When a content of Cr exceeds 0.5%, costs may increase, and low temperature toughness of a welding heat affected zone may be deteriorated.

Mo: 0.001 to 0.5%

Mo may delay the phase transformation during an accelerated cooling process and may consequently have an effect of greatly increasing strength. Also, Mo is an element which may have an effect of preventing the degradation of toughness caused by grain boundary segregation of impurities such as P, and the like.

When a content of Mo is lower than 0.001%, the above-described effect may be insufficient. When a content of Mo exceeds 0.5%, due to high hardenability, the formation of an MA phase may be facilitated in a welding heat affected zone such that fracture initiation resistance and fracture propagation arrestability at low temperature may greatly degrade.

Ca: 0.0002 to 0.005%

When Ca is added to molten steel after Al-deoxidize during a steel making process, Ca may be combined with S, mostly present as MnS, such that Ca may prevent the formation of MnS and may form spherical CaS at the same time. Accordingly, Ca may have an effect of preventing cracks in a central portion of the steel material. Thus, in the present disclosure, to allow added S to be formed as CaS sufficiently, 0.0002% or higher of Ca may need to be added.

When a content of Ca is excessive, residual Ca may be combined with O, and a coarse and hard oxidized inclusion may be formed, may be elongated and fractured during a subsequent rolling process, and may accordingly work as an initiation point of cracks at a low temperature. Thus, a preferable upper limit content of Ca may be 0.005%.

N: 0.001 to 0.006%

N is an element which may form a precipitation along with added Nb, Ti, and Al and may refine a grain of steel such that strength and toughness of a base material may improve. However, an excessive content of N is added, N may exist in a residual atomic state and may cause an aging phenomenon after cold deformation, and thus, N has been known as the most representative element which may decrease low temperature toughness. Also, it has been known that, when a slab is manufactured by a continuous casting process, N may cause surface cracks because of embrittlement at a high temperature.

Thus, in the present disclosure, considering that a content of Ti is 0.001 to 0.02%, a content of N may be limited to a range of 0.001 to 0.006%.

P: 0.02% or less (excluding 0%)

P is an element which may increase strength but may deteriorate low temperature toughness. Particularly, P may have the problem of greatly deteriorating low temperature toughness by grain boundary segregation in heat treatment steel. Thus, it may be preferable to control a content of P to be low as possible. However, as high costs may be required to excessively remove P during a steel making process, a content of P may be limited to be 0.02% or less.

S: 0.003% or less (excluding 0%)

S is a main cause of deteriorating low temperature toughness by being combined with Mn and forming a MnS inclusion in a central portion in a thickness direction of the steel sheet. Thus, to secure deformation aging impact properties at a low temperature, it may be preferable to remove S in a steel making process as possible, but as excessive costs may be required, a content of S may be limited to 0.003% or less.

0: 0.002% or less (excluding 0%)

0 may be formed as an oxidized inclusion by adding deoxidizers such as Si, Mn, Al, and the like, in a steel making process, and may be removed. When an appropriate amount of deoxidizer is not added, and an inclusion removing process is not properly performed, the amount of oxidized inclusion remaining in molten steel may increase, and a size of the inclusion may also greatly increase at the same time. The coarse oxidized inclusion which has not been removed may remain in fracture form or spherical form in steel during a rolling process in a steel making process, and may work as an initiation point of fracture at a low temperature or a propagation route of cracks. Thus, to secure impact properties and CTOD properties at a low temperature, the coarse oxidized inclusion may need to be prevented as possible. To this end, a content of O may be limited to 0.002% or less.

A remainder other than the above-described composition is Fe. However, in a general manufacturing process, inevitable impurities may be inevitably added from raw materials or a surrounding environment, and thus, impurities may not be excluded. A person skilled in the art may be aware of the impurities, and thus, the descriptions of the impurities may not be provided in the present disclosure.

The alloy composition of the present disclosure may need to satisfy the above-described element contents, and also, C, Si, and Sol.Al may need to satisfy Relational Expression 1 below.

$$5*C+Si+10*sol.Al \leq 0.6 \qquad \text{Relational Expression 1}$$

(in Relational Expression 1, each element symbol indicates a content of each element by wt %)

Relational Expressional 1 was designed in consideration of a degree of effect of each element affecting the formation of an MA phase. As indicated in FIG. 1, a fraction (dotted line) on an MA phase may increase in accordance with an increase of a value of Relational Expression 1 such that a ductility-brittleness transition temperature (solid line), low temperature impact properties of a steel, may increase. Thus, the more the value of Relational Expression 1 increases, the more the low temperature toughness may decrease. Thus, to sufficiently secure low temperature impact properties of a steel material and a CTOD value, it may be preferable to control a value of Relational Expression 1 to be 0.6 or lower.

In a welded zone, particularly in a SC-HAZ (sub-critically reheated heat affected zone), the most important position for guaranteeing a low temperature CTOD value, a temperature during welding is lower than a two-phase region temperature, and accordingly, the welding zone may have a microstructure almost similar to a microstructure of a base material. Thus, by controlling a value of Relational Expression 1 to be 0.6 or lower, low temperature impact properties and a CTOD value of the welded zone may be sufficiently secured.

A microstructure of the steel of the present disclosure may include a sum of polygonal ferrite and acicular ferrite of area % or higher, and may include an MA phase (martensite-austenite multiphase) of 3.5 area % or lower.

Acicular ferrite may be the most important and basic microstructure which may increase strength due to an effect of a fine grain size and may also interfere with propagation of cracks created at a low temperature. As polygonal ferrite may be coarse as compared to acicular ferrite, contribution of polygonal ferrite to increasing strength may be relatively low, but as polygonal ferrite has low dislocation density and a high angle grain boundary, polygonal ferrite is a microstructure which may greatly contribute to preventing the propagation at a low temperature.

When a sum of polygonal ferrite and acicular ferrite is lower than 50 area %, it may be difficult to prevent initiation and propagation of cracks at a low temperature, and it may be difficult to secure high strength, which may be problems. Thus, a sum of polygonal ferrite and acicular ferrite may be 50 area % or higher preferably, may be 70 area % or higher more preferably, and may be 85 area % or higher even more preferably.

An MA phase may not accommodate transformation due to high hardness such that deformation of a soft ferrite matrix around an MA phase may be concentrated, and beyond a limit point thereof, an interfacial surface with a ferrite matrix around an MA phase may be separated, or an MA phase may be fractured and may work as a crack initiation starting point, which may be the most important cause for deterioration of low temperature fracture properties of a steel material. Thus, it may be necessary to control an MA phase to be low as possible, and it may be preferable to control an MA phase to be 3.5 area % or less.

An average size of an MA phase measured in equivalent circular diameter may be 2.5 μm or less. When an average size of an MA phase exceeds 2.5 μm, stress may further be concentrated such that an MA phase may easily be fractured and may work as a crack initiation starting point.

Polygonal ferrite and acicular ferrite may not be process-hardened by a hot-rolling process. In other words, polygonal ferrite and acicular ferrite may be formed after a hot-rolling process.

When a hot-rolling temperature is low, coarse proeutectoid ferrite may be formed before finishing a hot-rolling process such that coarse proeutectoid ferrite may be elongated by a subsequent rolling process and may be process-hardened. Residual austenite may remain in band form and may be transformed to a structure including an MA hardened phase having high density such that low temperature impact properties and a CTOD value of a steel material may degrade.

A microstructure of a steel material may further include bainitic ferrite, cementite, and the like, in addition to polygonal ferrite, acicular ferrite, and an MA phase.

Bainitic ferrite is a structure transformed at a low temperature. Bainitic ferrite may have a large amount of dislocations therein, but may be relatively coarse as compared to other types of ferrite. Also, bainitic ferrite contains MA phase therein, and thus have high strength, but may be vulnerable to initiation and propagation of cracks. Thus, it may be required to control bainitic ferrite to minimum.

The steel of the present disclosure may include inclusions, and the number of inclusions having a size of 10 μm or higher may be 11 count/$cm^2$ or lower. The size may be measured in equivalent circular diameter.

When the number of inclusions having a size of 10 μm or greater exceeds 11 count/$cm^2$, the inclusion may work as a crack initiation point at a low temperature. To control such coarse inclusions, it may be preferable to add Ca or Ca alloys at a final stage of a secondary refining process, and to perform bubbling and refluxing processes using an Ar gas for three minutes.

A steel of the present disclosure may have yield strength of 355 MPa or higher, an impact energy value of 300 J or higher at −60° C., and a CTOD value of 0.3 mm or higher at −40° C. Also, the steel of the present disclosure may have tensile strength of 450 MPa or higher.

Also, the steel of the present disclosure may have a DBTT (ductility-brittleness transition temperature) of −60° C. or lower.

Method of Manufacturing High-Strength Steel Having Excellent Fracture Initiation Resistance and Fracture Propagation Arrestability at Low Temperature In the description below, a method of manufacturing high-strength steel having excellent fracture initiation resistance and fracture propagation arrestability at low temperature, another aspect of the present disclosure, will be described in detail.

The method of manufacturing high-strength steel having excellent fracture initiation resistance and fracture propagation arrestability at low temperature may include preparing a slab comprising the above-described alloy composition; heating the slab to 1000 to 1200° C.; obtaining a hot-rolled steel sheet by finish-hot-rolling the heated slab at 680° C. or higher; and cooling the hot-rolled steel sheet.

Preparing Slab

A slab satisfying the above-described alloy composition may be prepared.

The preparing the slab may include adding Ca or Ca alloys to molten steel in a final stage of a secondary refining process; and performing bubbling and refluxing processes using an Ar gas for at least three minutes after adding Ca or Ca alloys, which may be to control coarse inclusions.

Heating Slab

The slab may be heated to 1000 to 1200° C.

When the slab heating temperature is lower than 1000° C., re-solid solution of carbides, and the like, formed in the slab during a continuous casting process may be difficult, and homogenization of segregated elements may not be properly performed. Thus, it may be preferable to heat the slab to a temperature of 1000° C. or higher in which re-solid solution of 50% or higher of added Nb may be performed.

When the slab heating temperature exceeds 1200° C., an austenite grain size may coarsely grow, and refinement may be insufficient by a subsequent rolling process as well such that mechanical properties such as tensile strength, low temperature toughness, and the like, of the steel sheet may greatly degrade.

Hot-Rolling

The heated slab may be finish-hot-rolled at 680° C. or higher and a hot-rolled steel sheet may be obtained.

When the finish-hot-rolling temperature is lower than 680° C., Mn, and the like, may not be segregated during rolling such that proeutectoid ferrite may be formed in a region having low hardenability, and as ferrite is formed, C, and the like, which were solute, may be segregated to and thickened in a residual austenite region. The region in which C, and the like, is thickened may be transformed to upper bainite, martensite, or an MA phase during cooling after the rolling, and a strong layered structure including ferrite and a hard structure may be formed. A hard structure on a layer on which C, and the like, is thickened may have high hardness, and a fraction of an MA phase may also greatly increase. Consequently, due to an increase of a hard structure and the arrangement into the layered structure, low temperature toughness may greatly decrease. Thus, a rolling terminating temperature may need to be controlled to be 680° C. or higher.

Cooling

The hot-rolled steel sheet may be cooled.

The hot-rolled steel sheet may be cooled to 300 to 650° C. at a cooling rate of 2 to 30° C./s.

When the cooling rate is lower than 2° C./s, the cooling rate may be too low to avoid a ferrite and pearlite transformation section such that strength and low temperature toughness may be deteriorated. When the cooling rate exceeds 30° C./s, granular bainite or martensite may be formed such that strength may increase, but low temperature toughness may be greatly deteriorated.

When the cooling terminating temperature is lower than 300° C., it is highly likely that martensite or an MA phase may be formed. When the cooling terminating temperature exceeds 650° C., it may be difficult for a fine structure such as acicular ferrite, and the like, to be formed, and it is highly likely that coarse ferrite may be formed.

Meanwhile, if desired, a tempering process in which the cooled hot-rolled steel sheet is heated to 450 to 700° C., and is maintained for 1.3*t+10 minutes to 1.3*t+200 minutes and cooled may be performed, where t is a value of a thickness of the hot-rolled steel sheet measured in mm unit.

The tempering process may be performed to dissolve MA when excessive MA is formed, to remove high dislocation density, and to precipitate solute Nb, and the like, as carbonitride, although in small amount, so as to improve yield strength or low temperature toughness.

When the heating temperature is lower than 450° C., a ferrite matrix may not be sufficiently softened, and an embrittlement phenomenon may occur because of P segregation, and the like, which may rather deteriorate toughness. When a heating temperature exceeds 700° C., recovery and growth of a grain may occur rapidly, and at a higher temperature, re-transformation into austenite may occur such that yield strength may greatly decrease, and low temperature toughness may also be deteriorated at the same time.

When the maintaining time is lower than 1.3*t+10, homogenization of a structure may not be sufficiently performed. When the maintaining time exceeds 1.3*t+200, there may be the problem of degradation of productivity.

MODE FOR INVENTION

In the description below, an example embodiment of the present disclosure will be described in greater detail. It should be noted that the exemplary embodiments are provided to describe the present disclosure in greater detail, and to not limit the present disclosure.

A slab having a composition as indicated in Table 1 below was heated, hot-rolled, and cooled under conditions listed in Table 2 below, and a steel sample was manufactured.

A microstructure of the manufactured a steel sample was observed, properties were measured, and the results are listed in Table 3 below.

Also, the manufactured steel sample was welded with welding heat input listed in Table 2 below, and an impact energy value (−60° C.) and a CTOD value (−40° C.) of a welding heat affected zone (SCHAZ) were measured and listed in Table 3 below. As an impact energy value (−60° C.) and a CTOD value (−40° C.) of the steel sample were higher than those of a welding heat affected zone, an impact energy value (−60° C.) and a CTOD value (−40° C.) of the steel sample were not measured.

As for a microstructure of the steel sample, a cross-sectional surface of the manufactured steel sample was polished to a mirror surface and was etched using Nital or LePera depending on purposes, and an image of a certain area of a sample was measured in 100 to 5000 magnification using an optical or scanning electron microscope. A fraction of each phase was measured from the measured image using an image analyzer. To obtain statistically significant value, the measurement was repeatedly performed while changing the positions in the same sample, and an average value of the measurements was obtained.

As for a fine oxidized inclusion, the number of inclusions of 10 μm or greater was measured by scanning using a scanning electron microscope, and the result was listed in Inclusions (count/cm$^2$) in Table 3 below.

Properties of the steel sample was measured from a nominal change rate-nominal stress curve obtained through a general tensile test and was listed in the table.

An impact energy value (−60° C.) and a DBTT value of a welding heat affected zone were measured by performing an impact a charpy V-notch impact test.

As for a CTOD value (−40° C.), a sample was processed to have a size of B (thickness)×B (width)×5B (length) in perpendicular to a rolling direction depending on BS 7448 standards, fatigue cracks were inserted such that a fatigue crack length became about 50% of a sample width, and a CTOD test was performed at −40° C. B may be a thickness of the manufactured steel sample.

TABLE 1

| Classification | Steel type | Alloy Composition (weight %) | | | | | | | | | |
|---|---|---|---|---|---|---|---|---|---|---|---|
| | | C | Si | Mn | P | S | Sol. Al | Cu | Ni | Cr | Mo |
| Inventive Steel | a | 0.036 | 0.012 | 1.55 | 0.005 | 0.0015 | 0.011 | 0.07 | 0.52 | 0.03 | 0.18 |
| | b | 0.065 | 0.016 | 1.45 | 0.005 | 0.0012 | 0.012 | 0.12 | 0.62 | 0.02 | 0.05 |
| | c | 0.044 | 0.019 | 1.62 | 0.005 | 0.0008 | 0.032 | 0.05 | 0.45 | 0.02 | 0.08 |
| Comparative Steel | d | 0.052 | 0.231 | 1.53 | 0.005 | 0.0015 | 0.028 | 0.24 | 0.55 | 0.03 | 0.01 |
| | e | 0.095 | 0.110 | 1.44 | 0.005 | 0.0012 | 0.032 | 0.14 | 0.38 | 0.02 | 0.03 |
| | f | 0.016 | 0.050 | 1.52 | 0.005 | 0.0015 | 0.013 | 0.16 | 0.52 | 0.02 | 0.12 |
| | g | 0.061 | 0.131 | 1.65 | 0.005 | 0.0011 | 0.007 | 0.25 | 0.43 | 0.02 | 0.04 |
| | h | 0.074 | 0.210 | 1.61 | 0.006 | 0.0012 | 0.008 | 0.14 | 0.11 | 0.03 | 0.03 |
| | i | 0.084 | 0.111 | 1.55 | 0.004 | 0.0018 | 0.018 | 0.11 | 0.22 | 0.01 | 0.02 |

| Classification | Steel type | Alloy Composition (weight %) | | | | | | Relational Expression 1 |
|---|---|---|---|---|---|---|---|---|
| | | Ti | Nb | V | N | Ca | O | |
| Inventive Steel | a | 0.012 | 0.011 | 0.003 | 0.0035 | 0.0023 | 0.0007 | 0.31 |
| | b | 0.013 | 0.005 | 0.004 | 0.0038 | 0.0016 | 0.0008 | 0.46 |
| | c | 0.012 | 0.012 | 0.003 | 0.0041 | 0.0018 | 0.0012 | 0.56 |
| Comparative Steel | d | 0.013 | 0.009 | 0.002 | 0.0032 | 0.0023 | 0.0009 | 0.77 |
| | e | 0.012 | 0.006 | 0.003 | 0.0041 | 0.0018 | 0.0015 | 0.91 |
| | f | 0.012 | 0.010 | 0.003 | 0.0041 | 0.0018 | 0.0007 | 0.26 |
| | g | 0.013 | 0.011 | 0.002 | 0.0033 | 0.0022 | 0.0027 | 0.51 |
| | h | 0.013 | 0.023 | 0.002 | 0.0031 | 0.0018 | 0.0015 | 0.66 |
| | i | 0.011 | 0.012 | 0.003 | 0.0042 | 0.0025 | 0.0010 | 0.71 |

TABLE 2

| Classification | Steel type | Product thickness (mm) | Slab heating temperature (° C.) | Finish rolling temperature (° C.) | Cooling Rate (° C./s) | Cooling terminating temperature (° C.) | Welding heat input (kJ/cm) |
|---|---|---|---|---|---|---|---|
| Inventive Example 1 | a | 85 | 1060 | 990 | 6 | 465 | 50 |
| Inventive Example 2 | b | 76 | 1120 | 927 | 7 | 350 | 40 |
| Inventive Example 3 | c | 51 | 1075 | 913 | 10 | 380 | 30 |
| Comparative Example 1 | d | 51 | 1110 | 991 | 11 | 540 | 35 |
| Comparative Example 2 | e | 76 | 1080 | 949 | 7 | 320 | 45 |

TABLE 2-continued

| Classification | Steel type | Product thickness (mm) | Slab heating temperature (° C.) | Finish rolling temperature (° C.) | Cooling Rate (° C./s) | Cooling terminating temperature (° C.) | Welding heat input (kJ/cm) |
|---|---|---|---|---|---|---|---|
| Comparative Example 3 | f | 80 | 1120 | 890 | 6 | 470 | 45 |
| Comparative Example 4 | g | 51 | 1150 | 945 | 10 | 460 | 25 |
| Comparative Example 5 | b | 76 | 1220 | 894 | 6 | 520 | 45 |
| Comparative Example 6 | c | 25 | 1100 | 630 | 15 | 320 | 7 |
| Comparative Example 7 | b | 25 | 1180 | 854 | 42 | 320 | 11 |
| Comparative Example 8 | h | 76 | 1170 | 780 | 7 | 380 | 45 |
| Comparative Example 9 | i | 80 | 1160 | 766 | 6 | 260 | 50 |

TABLE 3

| Classification | Steel Type | PF + AF (area %) | MA (area %) | MA Diameter (μm) | Inclusions (count/cm$^2$) | Yield Strength (MPa) | Tensile Strength (MPa) | Impact Energy Value (−60° C., J) | CTOD Value (−40° C., mm) | DBTT Value (° C.) |
|---|---|---|---|---|---|---|---|---|---|---|
| Inventive Example 1 | a | 91 | 1.6 | 1.3 | 4 | 389 | 505 | 383 | 0.82 | −115 |
| Inventive Example 2 | b | 93 | 2.3 | 1.8 | 7 | 405 | 527 | 311 | 0.36 | −103 |
| Inventive Example 3 | c | 90 | 2.8 | 2.1 | 5 | 378 | 491 | 320 | 0.46 | −93 |
| Comparative Example 1 | d | 89 | 5.3 | 3.1 | 7 | 378 | 492 | 125 | 0.16 | −42 |
| Comparative Example 2 | e | 85 | 6.1 | 2.8 | 6 | 436 | 581 | 91 | 0.08 | −36 |
| Comparative Example 3 | f | 93 | 1.3 | 1.5 | 5 | 326 | 426 | 365 | 0.54 | −102 |
| Comparative Example 4 | g | 89 | 2.0 | 2.2 | 15 | 385 | 500 | 45 | 0.12 | −44 |
| Comparative Example 5 | b | 87 | 3.8 | 2.7 | 7 | 410 | 556 | 57 | 0.06 | −38 |
| Comparative Example 6 | c | 90 | 2.9 | 2.2 | 4 | 495 | 531 | 73 | 0.16 | −68 |
| Comparative Example 7 | b | 25 | 2.2 | 2.1 | 4 | 511 | 638 | 11 | 0.08 | −33 |
| Comparative Example 8 | h | 88 | 3.7 | 2.2 | 4 | 435 | 531 | 33 | 0.12 | −42 |
| Comparative Example 9 | i | 87 | 4.4 | 2.1 | 5 | 511 | 638 | 21 | 0.06 | −36 |

In Table 3 above, PF+AF may refer to a sum of polygonal ferrite and acicular ferrite.

It has been found that inventive examples 1 to 3 satisfying the alloy composition and the manufacturing conditions suggested in the present disclosure had excellent yield strength, and that an impact energy value and a CTOD value of a heat affected zone were high.

Comparative examples 1, 8, and 9 were samples in which the range of each element satisfied the ranges of the present disclosure, but a value of Relational Expression 1 exceeded 0.6. Accordingly, a hardened phase such as MA, and the like, was formed in the manufactured steel and in a welding heat affected zone, particularly in an SC-HAZ (sub-critically reheated heat affected zone), and consequently, low temperature toughness greatly degraded.

Comparative example 2 was a sample in which a content of added C exceeded the range of the present disclosure. C is the most effective element which may form MA, and as in comparative example 1, low temperature toughness of the manufactured steel and of a welding heat affected zone greatly degraded in comparative example 2.

Comparative example 3 was a sample in which a content of C was lower than the range of the present disclosure. As a content of C was low, the formation of a hardened phase such as MA, and the like, was greatly decreased such that low temperature toughness of the manufactured steel and of a welding heat affected zone greatly improved, but there was almost no effect of strengthening strength by C such that it was impossible to obtain a high strength steel material.

In comparative examples 4, the composition ranges of overall elements except for O satisfied the ranges of the present disclosure, but the management of the formation and removal of inclusions in a steel making process was not properly performed. Accordingly, a content of O in the product exceeded the range of the present disclosure such that a frequency of coarse oxidized inclusions exceeded the range of the present disclosure, and consequently, low temperature toughness greatly degraded in comparative examples 4.

When a removal of O is not properly performed in a steel making process, unremoved O may be present as an oxidized inclusion, and a fraction and a size thereof may increase. Such a coarse oxidized inclusion may rarely have ductility such that, during a subsequent process of manufacturing steel, a coarse oxidized inclusion may be fractured by a rolling weight during low temperature rolling, and may be present in elongated form in steel. Such a coarse oxidized inclusion may work as a path for crack initiation or crack propagation in a subsequent process or when external impact is applied, and may consequently work as an important factor which may greatly decrease low temperature toughness of steel or a welding heat affected zone.

Comparative examples 5 to 7 satisfied the each element content and a value of Relational Expression 1 suggested in the present disclosure, but the manufacturing conditions were beyond the ranges suggested in the present disclosure.

As for comparative example 5, a heating temperature of the manufactured slab exceeded the range of the present disclosure. As the slab heating temperature was too high, growth of austenite was greatly facilitated due to rolling and waiting at a high temperature. Accordingly, a large amount of coarse MA phase was formed such that low temperature toughness greatly degraded.

As for comparative example 6, a finish rolling temperature was lower than the range of the present disclosure. Coarse proeutectoid ferrite was formed before a rolling process was terminated, and austenite had an elongated form in a subsequent rolling process. Residual austenite remained in band form and was transformed to a structure including an MA hardened phase having high density. Consequently, due to the coarse and transformed structure and the locally high MA hardened phase, low temperature toughness degraded.

In comparative example 7, a fraction of a sum of polygonal ferrite and acicular ferrite was lower than the range of the present disclosure. When a steel having a low thickness is cooled at an excessively high cooling rate, the formation of ferrite may be prevented, and hard bainite or a martensite structure may be formed such that, although strength may greatly increase, low temperature toughness of a steel and of a welding heat affected zone may greatly decrease.

While exemplary embodiments have been shown and described above, the scope of the present disclosure is not limited thereto, and it will be apparent to those skilled in the art that modifications and variations could be made without departing from the scope of the present invention as defined by the appended claims.

The invention claimed is:

1. A high-strength steel comprising:

by wt %, 0.02 to 0.09% of C, 0.005 to 0.019% of Si, 0.5 to 1.68% of Mn, 0.001 to 0.035% of Sol.Al, 0.03% or less of Nb, excluding 0%, 0.01% or less of V, excluding 0%, 0.001 to 0.02% or Ti, 0.01 to 1.0% of Cu, 0.01 to 2.0% of Ni, 0.01 to 0.03% of Cr, 0.001 to 0.5% of Mo, 0.0002 to 0.005% of Ca, 0.001 to 0.006% of N, 0.02% or less of P, excluding 0%, 0.003% or less of S, excluding 0%, 0.002% or less of 0, excluding 0%, and a balance of Fe and inevitable impurities, wherein the high-strength steel satisfies Relational Expression 1 below, $$5*C+Si+10*sol.Al \leq 0.6 \quad \text{Relational Expression 1}$$

where each element symbol indicates a content of each element by wt %, wherein a microstructure comprises a sum of polygonal ferrite and acicular ferrite of 50 area % or higher, and comprises a martensite-austenite multiphase, an MA phase, of 3.5 area % or lower, and wherein the steel comprises inclusions, and a number of inclusions having a size of 10 μm or greater is 11 count/cm$^2$ or lower.

2. The high-strength steel of claim 1, wherein an average size of the MA phase measured in equivalent circular diameter is 2.5 μm or less.

3. The high-strength steel of claim 1, wherein polygonal ferrite and acicular ferrite are not process-hardened by a hot-rolling process.

4. The high-strength steel of claim 1, wherein the steel has yield strength of 355 MPa or higher, an impact energy value of 300 J or higher at −60° C., and a Crack Tip Opening Displacement Test (CTOD) value of 0.3 mm or higher at −40° C.

5. The high-strength steel of claim 1, wherein the steel has tensile strength of 450 MPa or higher.

6. A method of manufacturing a high-strength steel, the method comprising:

preparing a slab comprising, by wt %, 0.02 to 0.09% of C, 0.005 to 0.019% of Si, 0.5 to 1.68% of Mn, 0.001 to 0.035% of Sol.Al, 0.03% or less of Nb, excluding 0%, 0.01% or less of V, excluding 0%, 0.001 to 0.02% or Ti, 0.01 to 1.0% of Cu, 0.01 to 2.0% of Ni, 0.01 to 0.03% of Cr, 0.001 to 0.5% of Mo, 0.0002 to 0.005% of Ca, 0.001 to 0.006% of N, 0.02% or less of P, excluding 0%, 0.003% or less of S, excluding 0%, 0.002% or less of 0, excluding 0%, and a balance of Fe and inevitable impurities, and satisfying Relational Expression 1 below, $$5*C+Si+10*sol.Al \leq 0.6 \quad \text{Relational Expression 1}$$

where each element symbol indicates a content of each element by wt %; heating the slab to 1000 to 1200° C.;

finish-hot-rolling the heated slab at 680° C. or higher and obtaining a hot-rolled steel sheet;

cooling the hot-rolled steel sheet, and a tempering process in which the cooled hot-rolled steel sheet is heated to 450 to 700° C., and the heated hot-rolled steel sheet is maintained for 1.3*t+10 minutes to 1.3*t+200 minutes and is cooled, where t is a value of a thickness of the hot-rolled steel sheet measured in mm unit, wherein the cooling comprises cooling the hot-rolled steel sheet to a cooling terminating temperature of 300 to 650° C. at a cooling rate of 2 to 10° C./s, and wherein the preparing the slab comprises:

adding Ca or Ca alloys to molten steel in a final stage of a secondary refining process; and performing bubbling and refluxing processes using an Ar gas for at least three minutes after adding Ca or Ca alloys.

* * * * *